US007889150B2

(12) United States Patent
Gottwald et al.

(10) Patent No.: US 7,889,150 B2
(45) Date of Patent: Feb. 15, 2011

(54) CARRIER SYSTEM FOR A HIGH-FREQUENCY ANTENNA AND METHOD FOR ITS MANUFACTURE

(75) Inventors: Frank Gottwald, Weissach (DE); Johann Wehrmann, Balingen (DE); Thomas Haalboom, Maulbronn (DE); Hubert Straub, Nagold (DE); Hans Lubik, Bodelshusen (DE)

(73) Assignee: Robert Bosch GmbH, Stuttgart (DE)

( * ) Notice: Subject to any disclaimer, the term of this patent is extended or adjusted under 35 U.S.C. 154(b) by 389 days.

(21) Appl. No.: 11/662,822

(22) PCT Filed: Aug. 9, 2005

(86) PCT No.: PCT/EP2005/053919

§ 371 (c)(1),
(2), (4) Date: Sep. 15, 2008

(87) PCT Pub. No.: WO2006/032579

PCT Pub. Date: Mar. 30, 2006

(65) Prior Publication Data

US 2009/0015509 A1 Jan. 15, 2009

(30) Foreign Application Priority Data

Sep. 25, 2004 (DE) ..... 10 2004 046 633

(51) Int. Cl.
*H01Q 1/12* (2006.01)

(52) U.S. Cl. ..... 343/878

(58) Field of Classification Search ..... 343/700 MS, 343/702, 853, 878
See application file for complete search history.

(56) References Cited

U.S. PATENT DOCUMENTS

| | | | | |
|---|---|---|---|---|
| 6,037,903 | A * | 3/2000 | Lange et al. | 343/700 MS |
| 6,424,313 | B1 * | 7/2002 | Navarro et al. | 343/853 |
| 6,900,765 | B2 * | 5/2005 | Navarro et al. | 343/700 MS |
| 7,239,700 | B2 * | 7/2007 | Fuhrmann et al. | 379/433.11 |
| 7,315,288 | B2 * | 1/2008 | Livingston et al. | 343/770 |
| 7,348,932 | B1 * | 3/2008 | Puzella et al. | 343/853 |
| 2003/0067410 | A1 | 4/2003 | Puzella et al. | |
| 2005/0110681 | A1 * | 5/2005 | Londre | 343/700 MS |

FOREIGN PATENT DOCUMENTS

| | | |
|---|---|---|
| EP | 0 905 816 | 3/1999 |
| EP | 1 094 544 | 4/2001 |

* cited by examiner

*Primary Examiner*—Huedung Mancuso
(74) *Attorney, Agent, or Firm*—Kenyon & Kenyon LLP

(57) ABSTRACT

A carrier system for a high-frequency antenna having at least two electrodes situated at a predefined distance from one another and implemented as essentially flat, a dielectric being situated between the at least two electrodes, is distinguished in that the at least two electrodes are situated on a frame part which is as difficult to deform as possible. The frame part preferably has recesses or openings in such a way that air having $\epsilon_r$=1 is essentially situated between the at least two electrodes as the dielectric.

16 Claims, 3 Drawing Sheets

A-A

CARRIER SYSTEM FOR A HIGH-FREQUENCY ANTENNA AND METHOD FOR ITS MANUFACTURE

FIELD OF THE INVENTION

The present invention relates to a carrier system for a high-frequency antenna, in particular of an antenna radar which senses in the short range ("short-range radar"=SRR) for use in automobile technology, and a method for its manufacture according to the definitions of the species in the particular independent claims.

BACKGROUND INFORMATION

High-frequency (HF) antennas relevant here and used in, for example, the automobile radar technology cited are based on the principle of capacitive coupling and have for this purpose at least two electrode surfaces, situated at a small distance from one another, which are referred to as "patches" or "patch arrays" and are usually made of copper, in whose intermediate space a dielectric having a dielectric constant $\epsilon_T$ as close as possible to the value 1 is situated.

In order that the spacing between these electrode surfaces may be maintained as precisely as possible, the dielectric material is usually made of a solid. Plastic foam films or plastic foam slabs are usually used at the same time as carriers for the electrode surfaces, since these have the desired value of $\epsilon_r$ close to 1. The patches cited are applied to both sides of the dielectric material in this case.

The foam films cited have the disadvantages that $\epsilon_r$ is not precisely 1, the films are only poorly available in the large quantities required for mass production, and are also expensive, and their ability to be processed is still little tested in mass production; in particular in the field of automobile technology.

The present invention is thus based on the object of improving a carrier system of the type cited at the beginning in such a way that the above-mentioned disadvantages of the related art are corrected or avoided.

SUMMARY OF THE INVENTION

The carrier system according to the present invention is distinguished in particular in that the electrode surfaces cited ("patches") are situated on a frame part, which may be deformed as little as possible and at least partially has openings, which ensures that the spacing between the patches may be set precisely and permanently and, in addition, ensures that air having $\epsilon_r$=1 is used as the dielectric.

Using the frame part described, the precision achievable in the spacing between the patches and the precision of the value of $\epsilon_r$ to be achieved is significantly improved in relation to the related art.

In a preferred embodiment, the frame part cited is made of a hard plastic material such as PBT or GF30 and may be manufactured using customary injection molding technology. Such a plastic frame, which at least partially has openings, offers a simplified and thus even more cost-effective manufacture, in particular in mass production. The relatively low weight of such a plastic frame and the field testing of similar plastic frame parts which has already been performed in automobile technology additionally favors a use of the carrier system according to the present invention in automobiles.

In a further embodiment, a subset of the patches cited situated on one side of the frame part is pre-mounted in the form of an electrically conductive film. The remaining patches are situated on a circuit board which has further assemblies required for operation of the HF antenna. Patches situated stacked in this way generally increase the basically possible frequency bandwidth of the HF antenna.

For purposes of simplified mounting of the electrically conductive film onto the frame part, suitable adhesive layers may be pre-mounted on the film and/or onto the frame part.

Alternatively, holes may be provided on the film and assigned pins engaging in a tight-fitting manner in the holes cited may be provided on the frame part, using which the film may first be attached precisely guided to the frame part and the pins may subsequently be caulked or riveted using the effect of heat or ultrasound. The cited positioning of the fasteners offers the advantages of relatively high mounting precision and more cost-effective manufacturing of the antenna carrier according to the present invention.

The film may in turn alternatively be mounted directly onto the frame part using injection molding, the film being inserted into the molding die and the frame part then being injection-molded onto the film thus inserted. The film preferably adheres to the frame part through clawing of the injected plastic with holes positioned in the film. Because of the antenna carrier, which is deliverable ready for mounting in the way cited, no additional mounting processes are required, thereby making it possible to advantageously reduce the manufacturing costs again.

For purposes of even further simplified mounting of the frame part already provided with the film on the circuit board cited, a bonding technique may again be used, a suitable adhesive layer being applied onto the frame part and/or the circuit board using screen printing, for example, and covered using a protective film. With a frame part delivered in this state, for final mounting of the carrier system according to the present invention, the protective film is merely pulled off and the frame part is positioned and pressed onto the circuit board.

Alternatively, a suitable adhesive may be applied to the circuit board using other methods known per se such as dispensing or dosing and the frame part may then be placed onto the adhesive layer or into the not yet hardened adhesive.

The frame part may in turn alternatively be mechanically connected to the circuit board using removable fasteners, with the aid of clips, catches, or the like, for example.

The carrier system according to the present invention having the advantages cited may preferably be used in an HF antenna of an SRR preferably usable in automobile technology.

BRIEF DESCRIPTION OF THE DRAWINGS

The present invention will be described in greater detail in the following on the basis of a preferred exemplary embodiment illustrated in the attached drawing, from which further characteristics, features, and advantages of the present invention arise.

DETAILED DESCRIPTION

Figure 1:
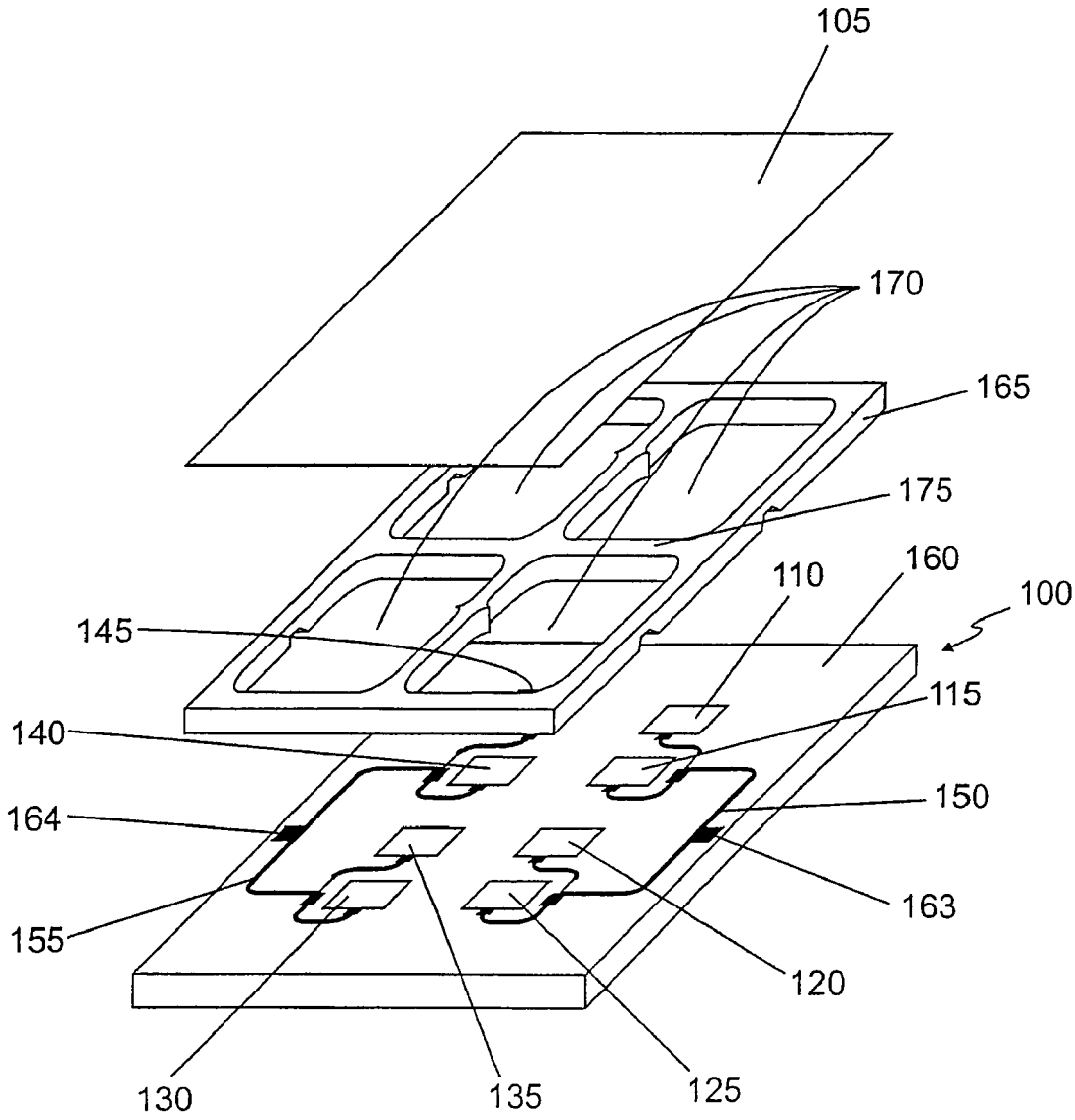
FIG. 1 shows a still unassembled carrier system according to the present invention for an HF antenna in an exploded illustration.

The HF antenna shown in FIG. 1 has two diametrically opposed electrodes 100, 105 in the present exemplary embodiment, active electrode 100, which is fed with an HF signal, being formed by a 2×4 patch array 110 through 145, which is situated essentially flat. This 2×4 patch array 110 through 145 includes two linear systems 110 through 125 and 130 through 145 of individual electrode surfaces, each two adjacent electrode pairs 110, 115 and 120, 125 as well as 130, 135 and 140, 145 being electrically connected in parallel using a conductor system 150. Electrode surfaces 110 through 145 are attached to a customary HF circuit board 160.

HF circuit board 160 is fed with the HF signal cited using two shielded electrical feed lines 163, 164. Second passive electrode 105 is situated at a defined distance from the 2×4 patch array and is implemented as a relatively thin FR4 circuit board of 0.1 mm thickness. The FR4 circuit board may also be implemented by a thin film.

A plastic frame 165 is situated between HF circuit board 160 and FR4 circuit board 105, using which the spacing between the two electrodes 100, 105 is precisely settable. The plastic frame has openings 170, because of which the dielectric between first electrodes 110 through 145 and second electrode 105 is formed by air.

To manufacture the antenna carrier shown in FIG. 1, cited FR4 circuit board 105 is initially applied to one side of plastic frame 165. Plastic frame 165 is then mounted onto HF circuit board 160, in the way shown in FIG. 1 over the 2×4 patch array.

FR4 circuit board 105 is preferably mounted onto plastic frame 165, in particular pre-mounted thereon, using one of the following attachment methods:

a) Adhesive layers (e.g., contact or adhesion adhesives) are already applied to FR4 circuit board 105 and/or to frame part 165, using which parts 105, 165 may be permanently bonded to one another by being pressed together. Frame part 165 also has corresponding webs 175 in the interior of 2×4 patch array 110 through 145 for this purpose, in order to also ensure the best possible adhesion in these areas. The adhesive layers may initially be covered by protective films.

b) Holes or openings are provided in FR4 circuit board or film 105 and pins (not shown) engaging in a tight-fitting manner in these holes/openings are provided on frame part 165. Using the holes and assigned pins, the FR4 circuit board or film is initially attached precisely guided on frame part 165 and the pins are subsequently caulked or riveted thereon using the effect of heat or ultrasound. A method for hot caulking applicable here is described, for example, in the prior application 10 2004 020684.4 (applicant reference number: R. 307250), to which reference is made in its entirety in the present context.

c) FR4 circuit board or film 105 is mounted directly onto frame part 165 using injection molding, the FR4 circuit board or film being inserted into the molding die and frame part 165 subsequently being injection-molded onto board/film 105 thus inserted. Board/film 105 preferably adheres to frame part 165 in this case through clawing of the injected plastic with holes positioned in board/film 105.

Frame part 165 already having FR4 circuit board 105 is mounted onto HF circuit board 160 preferably using one of the following attachment methods:

a') Use of a bonding technique, a suitable adhesive layer already having been applied onto frame part 165 and/or circuit boards 105, 160 using screen printing, for example, and is initially covered for transport purposes using a protective film. With frame part 165 thus delivered, the protective film is pulled off for the final mounting and frame part 165 is positioned and pressed onto circuit boards 105, 160.

b') A suitable adhesive is applied to circuit boards 105, 160 using methods known per se, such as dispensing or dosing, and subsequently thereto frame part 165 is placed onto the adhesive layer or into the adhesive.

c') Frame part 165 is mechanically connected to circuit boards 105, 160, with the aid of clips, catches, or the like, for example.

Figure 2B:
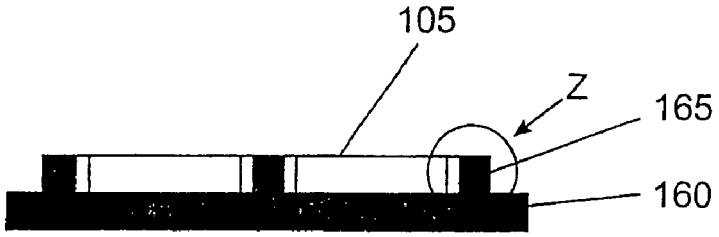
FIGS. 2*a* and 2*b* show a top view (a) of a carrier system according to the present invention from FIG. 1 and a lateral sectional view (b) along line A-A shown in FIG. 2*a*.
Figure 2A:
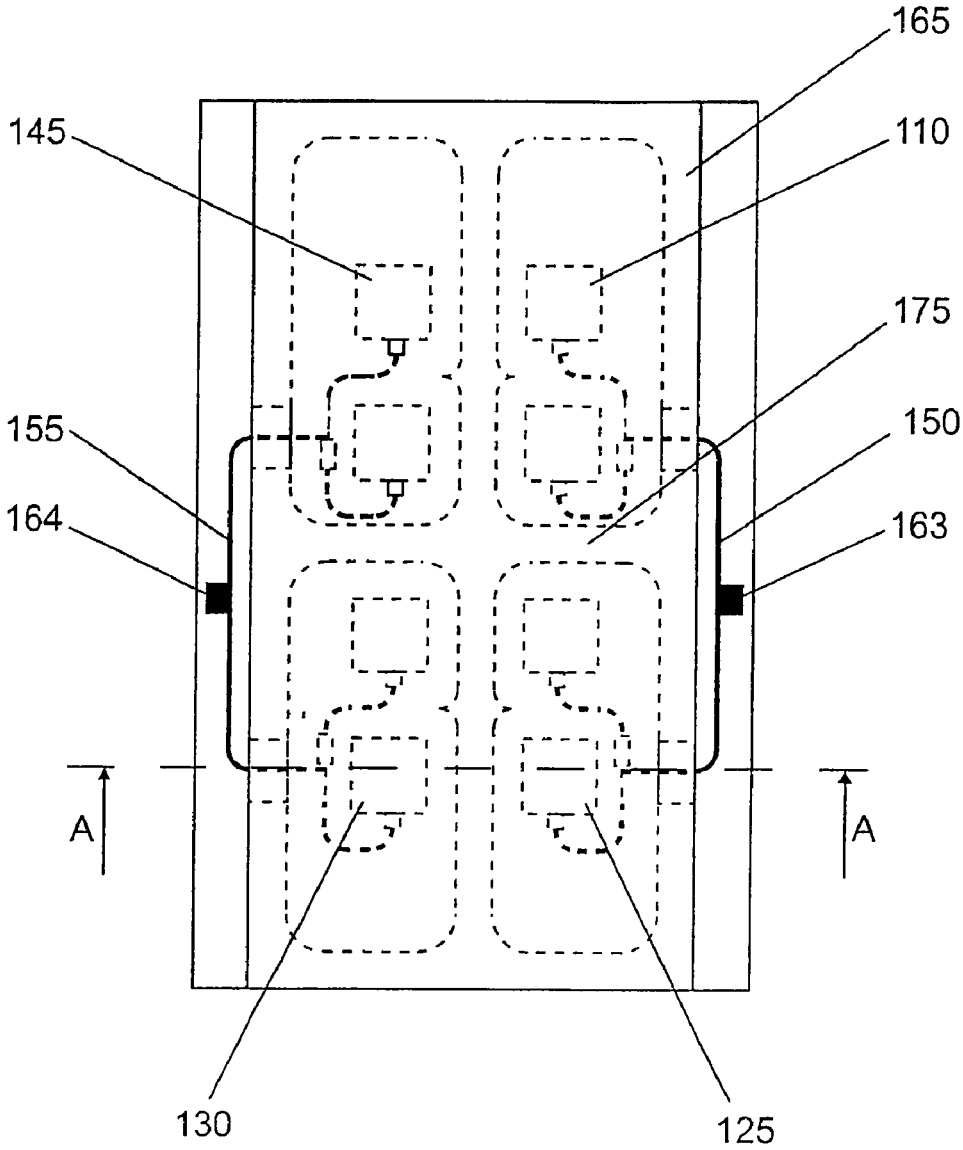

FIG. 2*a* shows a virtual top view of the already assembled antenna carrier system, which is also shown in an exploded illustration in FIG. 1, sectioned above HF circuit board 160. This top view illustrates in particular the relative positioning of electrodes 110 through 145 of the 2×4 patch array and webs 175 of frame part 165.

FIG. 2*b* shows a sectional view of the antenna carrier system along section line A-A indicated in FIG. 2*a*. FIG. 2*b* illustrates in particular the spatial positioning of FR4 circuit board 105 on frame part 165 and in turn the positioning of frame part 165 on HF circuit board 160. The mounting area identified by "Z" is additionally illustrated enlarged in FIG. 3.

Figure 3:
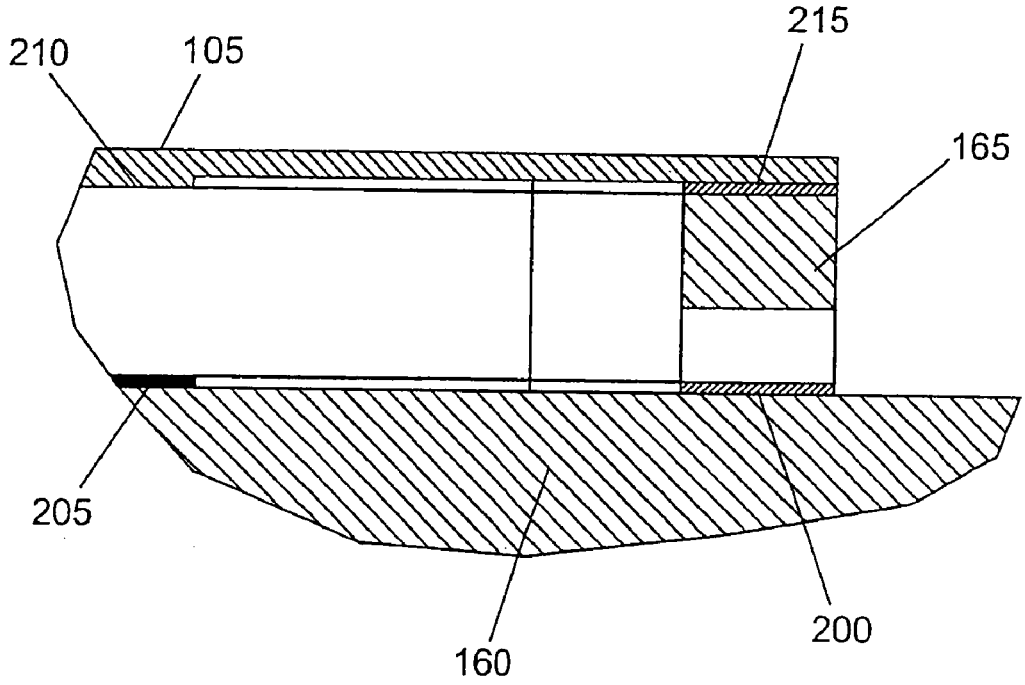
FIG. 3 shows an even more detailed lateral sectional view of a detail of the carrier system according to the present invention.

An exemplary first patch situated on HF circuit board 160 is identified in FIG. 3 by reference numeral "205." Using an adhesive layer 200, frame part 165, which is in vertical section (in the plane of the drawing) in the present illustration, is attached to HF circuit board 160. FR4 circuit board 105 is in turn attached to frame part 165 using a further adhesive layer 215. A second patch situated on FR4 circuit board 105 diametrically opposite first patch 205 is identified in the present case by reference numeral 210.

What is claimed is:

1. A carrier system for a high-frequency antenna, comprising:

at least two electrodes situated at a predefined distance from one another and being implemented as substantially flat;

a dielectric situated between the at least two electrodes; and a plastic frame part that is difficult to deform, wherein the at least two electrodes are situated on the plastic frame part;

wherein the frame part includes one of recesses and openings so that air having $\epsilon_r=1$ is essentially situated between the at least two electrodes as the dielectric, wherein a subset of the electrodes situated on one side of the frame part is pre-mounted in the form of an electrically conductive film and the remaining electrodes are situated on a circuit board which has further assemblies for operation of the high-frequency antenna.

2. The carrier system as recited in claim 1, wherein adhesive layers are situated on at least one of the film and the frame part, using which the electrically conductive film is mounted onto the frame part.

3. The carrier system as recited in claim 1, wherein holes are situated on the film and assigned pins engaging in the holes cited are situated on the frame part, using which the film is attached precisely guided to the frame part and the pins are attached thereto.

4. The carrier system as recited in claim 1, wherein the frame part is mechanically connected to the circuit board using one of clips and catches.

5. The carrier system as recited in claim 1, wherein the carrier system is used in a short range radar system.

6. The carrier system as recited in claim 1, wherein adhesive layers are situated on at least one of the film and the frame part, using which the electrically conductive film is mounted onto the frame part, wherein holes are situated on the film and assigned pins engaging in the holes cited are situated on the frame part, using which the film is attached precisely guided to the frame part and the pins are attached thereto.

7. The carrier system as recited in claim 6, wherein the frame part is mechanically connected to the circuit board using one of clips and catches.

8. A method for manufacturing a carrier system for a high-frequency antenna, comprising:

manufacturing at least two electrodes as substantially flat;

situating a dielectric between the at least two electrodes that are at a predefined distance from one another;

manufacturing a frame part from a plastic material that is difficult to deform; and situating the at least two electrodes on the frame part;

pre-mounting a subset of the electrodes situated on one side of the frame part in the form of an electrically conductive film; and situating the remaining electrodes on a circuit board which has further assemblies for operation of the high-frequency antenna;

wherein the frame part includes one of recesses and openings so that air having $\epsilon_r=1$ is essentially situated between the at least two electrodes as the dielectric.

9. The method as recited in claim 8, wherein the frame part is manufactured using injection molding.

10. The method as recited in claim 8, further comprising:

mounting the electrically conductive film onto the frame part using adhesive layers situated on at least one of the film and the frame part.

11. The method as recited in claim 8, further comprising:

providing holes on the electrically conductive film; and providing assigned pins engaging in the holes on the frame part, using which the electrically conductive film is first attached precisely guided onto the frame part and the pins are subsequently one of caulked and riveted using the effect of one of heat and ultrasound.

12. The method as recited in claim 8, further comprising:

mounting the electrically conductive film onto the frame part using injection molding, the electrically conductive film being inserted into a molding die and the frame part then being injection-molded onto the electrically conductive film thus inserted, the electrically conductive film adhering to the frame part through clawing of the injected plastic with holes positioned in the electrically conductive film.

13. The method as recited in claim 8, further comprising:

gluing the frame part already provided with the electrically conductive film to the circuit board, a suitable adhesive layer being applied to the at least one of the frame part and the circuit board, using screen printing, and covered using a protective film, the protective film being pulled off and the frame part being positioned and pressed onto the circuit board for final mounting.

14. The method as recited in claim 8, further comprising:

applying an adhesive agent to the circuit board using one of dispensing and dosing; and placing the frame part onto the adhesive agent.

15. The method as recited in claim 8, further comprising:

mechanically connecting the frame part to the circuit board using one of clips and catches.

16. The method as recited in claim 8, further comprising:

applying an adhesive agent to the circuit board using one of dispensing and dosing; and placing the frame part onto the adhesive agent; and mechanically connecting the frame part to the circuit board using one of clips and catches.

* * * * *